US010612387B2

(12) United States Patent
Malmborg

(10) Patent No.: US 10,612,387 B2
(45) Date of Patent: Apr. 7, 2020

(54) AIRFOIL DAMPING ASSEMBLY FOR GAS TURBINE ENGINE

(71) Applicant: United Technologies Corporation, Farmington, CT (US)

(72) Inventor: Eric W. Malmborg, Amston, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 223 days.

(21) Appl. No.: 15/605,502

(22) Filed: May 25, 2017

(65) Prior Publication Data

US 2018/0340425 A1 Nov. 29, 2018

(51) Int. Cl.

| | |
|---|---|
| ***F01D 5/16*** | (2006.01) |
| ***F01D 5/10*** | (2006.01) |
| ***F04D 29/38*** | (2006.01) |
| ***F01D 5/26*** | (2006.01) |
| ***F01D 5/18*** | (2006.01) |

(52) U.S. Cl.

CPC ..... *F01D 5/16* (2013.01); *F01D 5/10* (2013.01); *F01D 5/18* (2013.01); *F01D 5/26* (2013.01); *F04D 29/388* (2013.01); *F05D 2220/32* (2013.01); *F05D 2260/96* (2013.01)

(58) Field of Classification Search

CPC ..... F01D 5/16; F01D 5/10; F01D 5/18; F01D 5/26; F01D 2220/32; F01D 2260/96; F04D 29/388

See application file for complete search history.

(56) References Cited

U.S. PATENT DOCUMENTS

| | | | | |
|---|---|---|---|---|
| 2,984,453 | A * | 5/1961 | Heymann | F01D 5/16 416/229 R |
| 5,232,344 | A * | 8/1993 | El-Aini | F01D 5/16 416/145 |
| 5,634,771 | A | 6/1997 | Howard et al. | |
| 5,947,688 | A | 9/1999 | Schilling et al. | |
| 6,033,186 | A | 3/2000 | Schilling et al. | |
| 6,039,542 | A | 3/2000 | Schilling et al. | |
| 8,821,124 | B2 | 9/2014 | Viens et al. | |
| 10,215,029 | B2 * | 2/2019 | Wygant | F01D 5/16 |
| 2002/0090302 | A1 | 7/2002 | Norris et al. | |
| 2011/0070085 | A1 * | 3/2011 | El-Aini | F01D 5/16 416/145 |

(Continued)

FOREIGN PATENT DOCUMENTS

| | | | |
|---|---|---|---|
| EP | 1811129 | A2 | 7/2007 |
| EP | 2014872 | A2 | 1/2009 |
| EP | 2947271 | A1 | 11/2015 |

(Continued)

OTHER PUBLICATIONS

Search Report regarding related EP App. No. 18173446.8; dated Jun. 28, 2018; 7 pgs.

*Primary Examiner* — Kevin A Lathers

(74) *Attorney, Agent, or Firm* — Cantor Colburn LLP

(57) ABSTRACT

An airfoil damping assembly includes an airfoil defining a hollow interior. Also included is an airfoil plurality of ribs disposed within the hollow interior. Further included is a plurality of cavities, each of the cavities defined by at least one of the plurality of ribs. Yet further included is a damping fluid disposed in one of the cavities to damp vibratory stresses of the airfoil during operation.

19 Claims, 2 Drawing Sheets

(56) References Cited

U.S. PATENT DOCUMENTS

| | | | | |
|---|---|---|---|---|
| 2013/0001837 | A1* | 1/2013 | Gohler | B22F 3/1055<br>264/497 |
| 2016/0237828 | A1* | 8/2016 | Burd | B22F 5/04 |

FOREIGN PATENT DOCUMENTS

| | | | |
|---|---|---|---|
| GB | 2397855 | A | 1/2003 |
| GB | 2403987 | A | 7/2003 |
| WO | 2015112891 | A1 | 7/2015 |

* cited by examiner

AIRFOIL DAMPING ASSEMBLY FOR GAS TURBINE ENGINE

BACKGROUND

Exemplary embodiments pertain to the art of gas turbine engines and, more particularly, to a damping assembly for airfoils in gas turbine engines.

Gas turbine engine operation often subjects the engine components to harsh operating conditions. Airfoils are one example of a component that must withstand high temperature, pressure, and excitation during operation. Airfoils experience several types of excitation that induce vibratory stress. The vibratory stresses can be high enough to cause fracture of the component. It is desirable to provide a damping scheme that is minimally intrusive with respect to the basic blade design, however various systems that attempt to do so suffer from different flaws. Therefore, improvement on vibration damping is desired.

BRIEF DESCRIPTION

Disclosed is an airfoil damping assembly including an airfoil defining a hollow interior. Also included is an airfoil plurality of ribs disposed within the hollow interior. Further included is a plurality of cavities, each of the cavities defined by at least one of the plurality of ribs. Yet further included is a damping fluid disposed in one of the cavities to damp vibratory stresses of the airfoil during operation.

In addition to one or more of the features described above, or as an alternative, further embodiments may include that the damping fluid comprises an elastomeric compound.

In addition to one or more of the features described above, or as an alternative, further embodiments may include that the plurality of cavities include a row of cavities located adjacent a root wall of the airfoil, the damping fluid disposed in one of the row of cavities.

In addition to one or more of the features described above, or as an alternative, further embodiments may include that the row of cavities is radially inward of a solid chordwise rib, the solid chordwise rib being one of the plurality of ribs disposed in the hollow interior.

In addition to one or more of the features described above, or as an alternative, further embodiments may include that the damping fluid is disposed in more than one of the plurality of cavities.

In addition to one or more of the features described above, or as an alternative, further embodiments may include that the damping fluid completely fills the cavity.

In addition to one or more of the features described above, or as an alternative, further embodiments may include that the damping fluid partially fills the cavity.

In addition to one or more of the features described above, or as an alternative, further embodiments may include a hole extending from one of the cavities to an exterior of the airfoil, wherein the damping fluid is routed through the hole to the cavity.

In addition to one or more of the features described above, or as an alternative, further embodiments may include that the hole extends to through a root wall of the airfoil.

In addition to one or more of the features described above, or as an alternative, further embodiments may include a plurality of holes, each of the holes extending from one of the plurality of cavities to an exterior of the airfoil.

In addition to one or more of the features described above, or as an alternative, further embodiments may include that which of the plurality of cavities contains the damping fluid and the total amount of damping fluid to be disposed in the cavity is determined by at least one operational factor of the airfoil.

In addition to one or more of the features described above, or as an alternative, further embodiments may include that the at least one operational factor comprises at least one of a magnitude of damping required, a vibratory mode to be damped, the volume available for damping material, and the hydrostatic loads created by damping fluid on the airfoil.

Also disclosed is a gas turbine engine including a fan section, a compressor section, a turbine section, and an airfoil disposed in one of the fan section, the compressor section, and the turbine section. The airfoil includes a hollow interior. The airfoil also includes at least one spanwise rib extending in a spanwise direction of the airfoil. The airfoil further includes at least one chordwise rib extending in a chordwise direction of the airfoil. The airfoil yet further includes a plurality of cavities, each of the cavities defined by at least one spanwise rib and/or at least one chordwise rib. The airfoil also includes a damping fluid comprising an elastomeric compound disposed in at least one of the cavities to damp vibratory stresses of the airfoil during operation, the plurality of cavities including a row of cavities located adjacent a root wall of the airfoil, the damping fluid disposed in one of the row of cavities.

In addition to one or more of the features described above, or as an alternative, further embodiments may include that the damping fluid completely fills the cavity.

In addition to one or more of the features described above, or as an alternative, further embodiments may include that the damping fluid partially fills the cavity.

In addition to one or more of the features described above, or as an alternative, further embodiments may include a hole extending from one of the cavities to an exterior of the airfoil, wherein the damping fluid is routed through the hole to the cavity.

In addition to one or more of the features described above, or as an alternative, further embodiments may include that the hole extends to through a root wall of the airfoil.

In addition to one or more of the features described above, or as an alternative, further embodiments may include a plurality of holes, each of the holes extending from one of the plurality of cavities to an exterior of the airfoil.

In addition to one or more of the features described above, or as an alternative, further embodiments may include that which of the plurality of cavities contains the damping fluid and the total amount of damping fluid to be disposed in the cavity is determined by at least one operational factor of the airfoil, the at least one operational factor comprising at least one of a magnitude of damping required, a vibratory mode to be damped, the volume available for damping material, and the hydrostatic loads created by damping fluid on the airfoil.

Further disclosed is a method of damping vibratory stresses of a gas turbine engine airfoil. The method includes determining a dynamic response of an airfoil during operation. The method also includes injecting a damping fluid into at least one of a plurality of cavities defined by ribs of the airfoil, the ribs extending within a hollow region of the airfoil.

wherein the damping fluid is disposed in more than one of the plurality of cavities

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
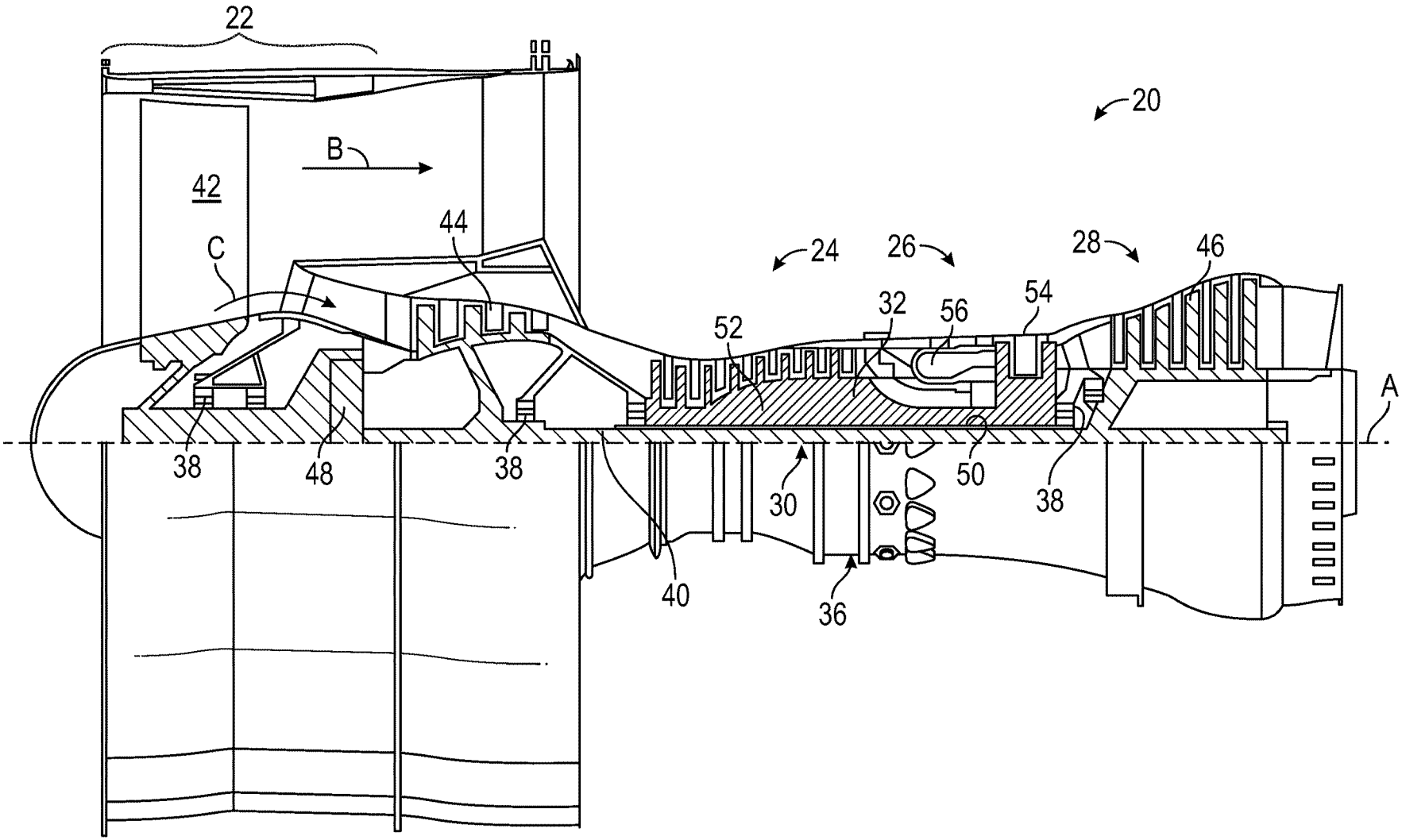
FIG. 1 is a partial cross-sectional view of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five (5:1). Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and 35,000 feet (10,688 meters). The flight condition of 0.8 Mach and 35,000 feet (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\text{R})/(518.7^\circ\text{R})]^{0.5}$. The "Low corrected fan tip speed" as disclosed herein according to one non-limiting embodiment is less than about 1150 ft/second (350.5 m/sec).

Figure 2:
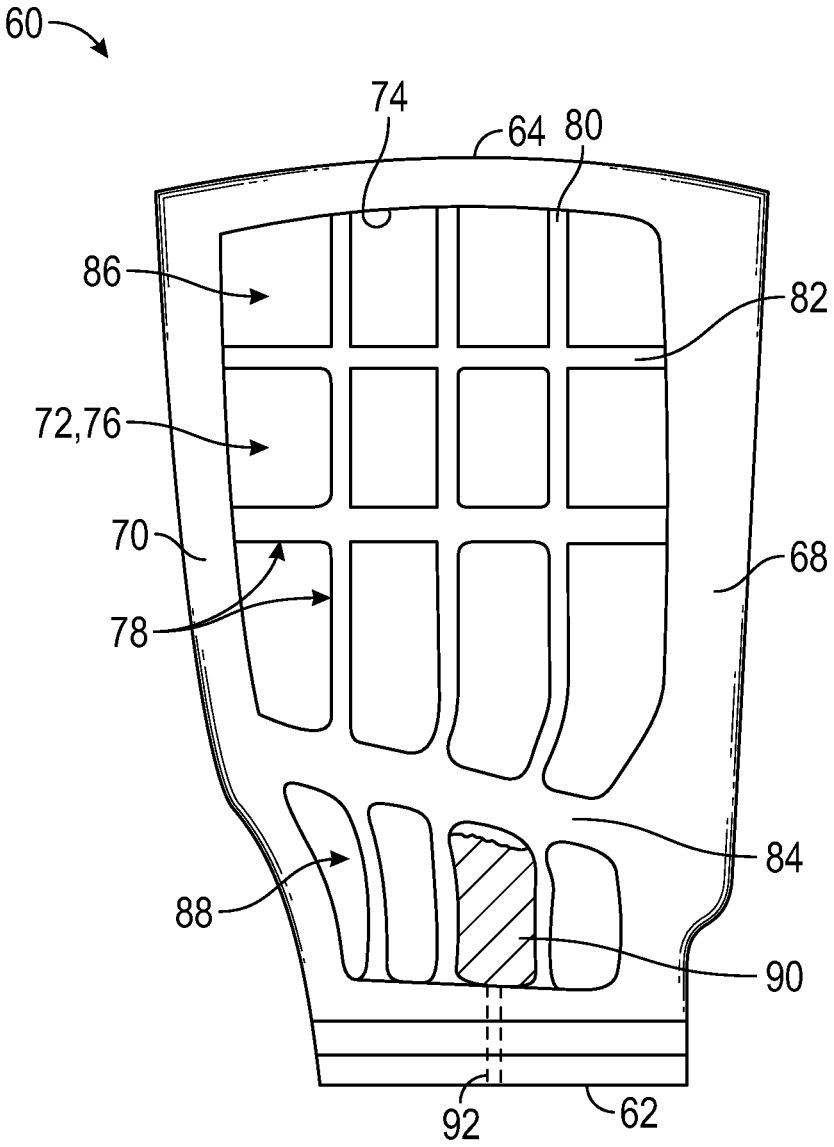
FIG. 2 is a sectional view of an airfoil of the gas turbine engine.

Referring now to FIG. 2, an airfoil 60 of the gas turbine engine 20 is illustrated. Various sections of the gas turbine engine 20 may benefit from the embodiments of the airfoil 60 described herein. For example, the airfoil 60 may be located in the fan section 22, the compressor section 24, or the turbine section 28. The airfoil 60 is operatively coupled to a rotor of the engine 20 proximate a root 62 of the airfoil 60. The airfoil 60 extends radially away from the rotor to an end of the airfoil 60 that is distal relative to the root 62, with the distal end referred to as a tip 64. The airfoil 60 also includes a leading edge 68 and a trailing edge 70.

The airfoil 60 includes a generally hollow region 72 defined by an inner surface 74 of walls of the airfoil 60, with the walls located proximate the root 62, the tip 64, the leading edge 68 and the trailing edge 70. The generally hollow region 72 reduces the weight of the airfoil 60. The generally hollow region 72 is divided into cavities 76. The cavities 76 are defined by at least one of the illustrated ribs 78. As shown, some of the ribs 78 extended in a substantially spanwise direction of the airfoil 60 and are considered spanwise ribs 80, while some of the ribs extend in substantially chordwise direction and are considered chordwise ribs 82. It is to be understood that the ribs 78 may be disposed at alternative orientations, such as orientations that are angled relative to the chordwise and/or spanwise directions.

One of the chordwise ribs 82 is a primary rib and is referenced with numeral 84. The primary rib 84 divides the cavities 76 into at least one radially outer cavity 86 and at least one radially inner cavity 88. As shown in the illustrated embodiment, a plurality of radially outer cavities may be present and/or a plurality of radially inner cavities may be present.

To damp vibratory stresses experienced by the airfoil 60 during operation, a damping fluid 90 is contained within one of the cavities 76. The damping fluid 90 may partially or completely fill the cavity that it is disposed in. Although the damping fluid 90 is only disposed in a single cavity in the illustrated embodiment, it is to be understood that multiple cavities may contain the damping fluid 90. In the illustrated embodiment, the damping fluid 90 is disposed within one of the radially inner cavities 88. Disposing the damping fluid 90 proximate the root 62 of the airfoil 60 provides a damping effect that may be tuned based on the specific needs of the airfoil 60. However, it is contemplated that the damping fluid 90 may be disposed in one of the radially outer cavities 86 as an alternative to, or in combination with, disposal of the damping fluid 90 in at least one of the radially inner cavities 88.

The damping fluid 90 may be any suitable fluid. In one embodiment, the damping fluid 90 is a fluid that comprises an elastomeric compound. It is contemplated that different cavities 76 contain different types of fluids in some embodiments. The damping fluid 90 is injected into the desired cavity with a hole 92 that extends from an outer surface of the airfoil 60 to the desired cavity. In the illustrated embodiment, the hole 92 extends from the root 62 to the cavity 76, but it is to be appreciated that the hole 92 may be located alternatively. Furthermore, multiple holes may be provided to allow access to various cavities 76.

Various design considerations may be taken into account when determining placement, type, and amount of damping fluid 90 to be included. Such design considerations include the magnitude of damping required, the vibratory mode to be damped, the volume available for damping material, and the hydrostatic loads created by damping fluid on the airfoil structure. These considerations influence which of the cavities 76 should be filled and the radial extent of the damper. Advantageously, by designing the airfoil 60 to handle the loading from an elastomeric fluid, higher vibratory stress environments can be endured when compared to an undamped design.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An airfoil damping assembly comprising:
an airfoil defining a hollow interior;
a plurality of solid, impermeable ribs disposed within the hollow interior;
a plurality of cavities, each of the cavities defined by at least one of the plurality of ribs, the plurality of cavities including a radially inner row of cavities and a radially outer row of cavities, the radially inner row of cavities located adjacent a root wall of the airfoil and radially inward of a solid chordwise rib, the solid chordwise rib being one of the plurality of solid, impermeable ribs, the radially outer row of cavities located radially outward of the solid chordwise rib; and
a damping fluid disposed in one of the cavities to damp vibratory stresses of the airfoil during operation.

2. The airfoil damping assembly of claim 1, wherein the damping fluid comprises an elastomeric compound.

3. The airfoil damping assembly of claim 1, wherein the damping fluid is disposed in one of the row of cavities.

4. The airfoil damping assembly of claim 1, wherein the damping fluid is disposed in more than one of the plurality of cavities.

5. The airfoil damping assembly of claim 1, wherein the damping fluid completely fills the cavity.

6. The airfoil damping assembly of claim 1, wherein the damping fluid partially fills the cavity.

7. The airfoil damping assembly of claim 1, further comprising a hole extending from one of the cavities to an exterior of the airfoil, wherein the damping fluid is routed through the hole to the cavity.

8. The airfoil damping assembly of claim 7, wherein the hole extends to through a root wall of the airfoil.

9. The airfoil damping assembly of claim 7, further comprising a plurality of holes, each of the holes extending from one of the plurality of cavities to an exterior of the airfoil.

10. The airfoil damping assembly of claim 1, wherein which of the plurality of cavities contains the damping fluid and the total amount of damping fluid to be disposed in the cavity is determined by at least one operational factor of the airfoil.

11. The airfoil damping assembly of claim 10, wherein the at least one operational factor comprises at least one of a magnitude of damping required, a vibratory mode to be damped, the volume available for damping material, and the hydrostatic loads created by damping fluid on the airfoil.

12. A gas turbine engine comprising:
a fan section;
a compressor section;
a turbine section; and
an airfoil disposed in one of the fan section, the compressor section, and the turbine section, the airfoil comprising:
a hollow interior;
at least one solid, impermeable spanwise rib extending in a spanwise direction of the airfoil;

at least one solid, impermeable chordwise rib extending in a chordwise direction of the airfoil;

a plurality of cavities, each of the cavities defined by at least one spanwise rib and/or at least one chordwise rib; and a damping fluid comprising an elastomeric compound disposed in at least one of the cavities to damp vibratory stresses of the airfoil during operation, the plurality of cavities including a row of cavities located adjacent a root wall of the airfoil, the damping fluid disposed in one of the row of cavities, wherein the damping fluid is disposed in more than one of the plurality of cavities.

13. The airfoil damping assembly of claim 12, wherein the damping fluid completely fills the cavity.

14. The airfoil damping assembly of claim 12, wherein the damping fluid partially fills the cavity.

15. The airfoil damping assembly of claim 12, further comprising a hole extending from one of the cavities to an exterior of the airfoil, wherein the damping fluid is routed through the hole to the cavity.

16. The airfoil damping assembly of claim 15, wherein the hole extends to through a root wall of the airfoil.

17. The airfoil damping assembly of claim 15, further comprising a plurality of holes, each of the holes extending from one of the plurality of cavities to an exterior of the airfoil.

18. The airfoil damping assembly of claim 12, wherein which of the plurality of cavities contains the damping fluid and the total amount of damping fluid to be disposed in the cavity is determined by at least one operational factor of the airfoil, the at least one operational factor comprising at least one of a magnitude of damping required, a vibratory mode to be damped, the volume available for damping material, and the hydrostatic loads created by damping fluid on the airfoil.

19. A method of damping vibratory stresses of a gas turbine engine airfoil, the method comprising:

determining a dynamic response of an airfoil during operation;

injecting a damping fluid into at least one of a plurality of cavities, each of the plurality of cavities being defined by at least one of a plurality of solid impermeable ribs of the airfoil, the plurality of cavities including a radially inner row of cavities and a radially outer row of cavities, the radially inner row of cavities located adjacent a root wall of the airfoil and radially inward of a solid chordwise rib, the solid chordwise rib being one of the plurality of solid, impermeable ribs, the radially outer row of cavities located radially outward of the solid chordwise rib; and wherein the damping fluid when disposed in one of the plurality of cavities dampens vibratory stresses of the airfoil during operation.

* * * * *